US005481344A

United States Patent [19]

Yasuda et al.

[11] Patent Number: 5,481,344

[45] Date of Patent: Jan. 2, 1996

[54] AUXILIARY DEVICE, CARTRIDGE AND APPARATUS FOR TONER SUPPLY

[75] Inventors: Shinichiro Yasuda, Osaka; Hideyo Nishikawa, Hannan, both of Japan

[73] Assignee: Kao Corporation, Tokyo, Japan

[21] Appl. No.: 282,062

[22] Filed: Jul. 21, 1994

[30] Foreign Application Priority Data

Jul. 31, 1993 [JP] Japan ..... 5-208321
Nov. 4, 1993 [JP] Japan ..... 5-301043

[51] Int. Cl.[6] ..... G03G 15/06

[52] U.S. Cl. ..... 355/260; 222/DIG. 1

[58] Field of Search ..... 355/245, 260; 222/DIG. 1

[56] References Cited

U.S. PATENT DOCUMENTS 4,519,693 5/1985 Skeels ..... 355/260

FOREIGN PATENT DOCUMENTS

| | | | |
|---|---|---|---|
| 55-134875 | 10/1980 | Japan . | |
| 59-93471 | 5/1984 | Japan . | |
| 59-105663 | 6/1984 | Japan | 355/260 |
| 60-80878 | 5/1985 | Japan . | |
| 60-130772 | 7/1985 | Japan . | |
| 1-91163 | 4/1989 | Japan | 355/260 |
| 1-120587 | 5/1989 | Japan | 355/260 |
| 3-47569 | 5/1991 | Japan . | |
| 3-118573 | 5/1991 | Japan | 355/260 |

*Primary Examiner*—William J. Royer
*Attorney, Agent, or Firm*—Birch, Stewart, Kolasch & Birch

[57] ABSTRACT

A cover 10 is provided to cover the opening of a toner container 2. The cover 10 is attachable to, and detachable from, the toner container 2. A valve element 12 capable of closing the opening 11 formed in the cover 10 is pressed up to an opening position by a pressing-up portion 20 provided on a developing apparatus side. Shifting of the valve element 12 to the opening position makes it possible to supply the toner from the toner container 2 to the developing apparatus.

8 Claims, 18 Drawing Sheets

102
102a
102b
103
104
106
106a
106b
106c
107
109
109a
110
110a
110a'
110b
111
111a
111b
113
113a
114
114a
117

Prior Art

AUXILIARY DEVICE, CARTRIDGE AND APPARATUS FOR TONER SUPPLY

FIELD OF THE INVENTION

The present invention relates to an auxiliary device, cartridge and apparatus for toner supply to a developing apparatus for a copying machine etc.

DESCRIPTION OF THE PRIOR ART

Since the toner used as an electrophotographic developing agent is a micron-sized fine powder, toner scattering and leakage during toner supply to the toner tank of a developing apparatus results in contamination of the inside and outside of the copying machine etc. and the worker's skin and wears. To cope with this problem, there have been proposed various cartridges and apparatuses for toner supply.

For example, there have been proposed toner cartridges comprising a toner container and a sealing element which seals the outlet of the toner container, wherein toner is supplied from the toner container to the developing apparatus by removing the sealing element after attachment of the cartridge to the developing apparatus (see Japanese Unexamined Patent Publication SHO No. 59-93471 and Japanese Unexamined Utility Model Publication HEI No. 3-47569). However, it is troublesome to remove the sealing element. Disposal of the sealing element to which the toner adheres poses a problem of environmental pollution. In addition, when the sealing element to which the toner adheres is disposed of in a trash box, the worker's hands are stained and/or the toner scatters in the trash box. To prevent the toner adhering to the sealing element from scattering, further troublesome operation is required. Also, when the used toner container is removed from the developing apparatus, the toner remaining in the toner container can spill.

There have also been proposed apparatuses for toner supply wherein toner is supplied from the toner container to the developing apparatus. The developing apparatus a mechanism for opening and closing the toner supply port, which is opened by rotating or shifting the toner container attached to the developing apparatus (see Japanese Unexamined Patent Publications SHO No. 55-134875 and SHO No. 60-130772). However, provision of such a mechanism for opening and closing the toner supply port results in an increased cost due to the complex structure. Also, troublesome operations such as the rotation and shifting of the toner container are necessary after the toner container is attached to the developing apparatus. Moreover, the toner which adheres to the toner container attaching portion of the developing apparatus can spill when the toner container is rotated or shifted.

Also, as shown in FIG. 18A, there has been proposed an apparatus for toner supply comprising a toner container 201, a valve element 203 which opens and closes the outlet 202 of the toner container 201, a spring 206 which exerts an elastic force on the valve element 203 to move the valve element 203 to the closing position, a pressing-up portion 204 provided at the center of the toner supply port 205 on the developing apparatus side, and a guide face 207 formed in a copying machine etc., wherein the valve element 203 has a central hole 203*a* (see Japanese Unexamined Patent Publication SHO No. 60-80878). As shown in FIG. 18B, as the toner container 201 is lowered along the guide face 207, the pressing-up portion 204 is inserted in the central hole 203*a* of the valve element 203, and the valve element 203 is pressed up to an opening position of the outlet 202 against the elastic force of the spring 206, so that the toner in the toner container 201 is fed to the toner supply port 205. However, since the toner container 201 has the valve element 203 therein, production cost is high, and one-time use and disposal is uneconomical. Also, if the pressing-up portion 204 is not precisely placed at the center of the toner supply port 205, the valve element 203 cannot be pressed up completely, which in turn interferes with toner supply. Moreover, when the pressing-up portion 204 is provided at the center of the toner supply port 205, the structure becomes complex. Furthermore, because the toner container 201 has a closed end, it is difficult to incorporate the valve element 203 and spring 206 therein.

The object of the present invention is to provide an auxiliary device, cartridge and apparatus for toner supply which are free of the above problems.

SUMMARY OF THE INVENTION

An auxiliary device for toner supply to a developing apparatus according to the present invention comprises a cover attachable to, and detachable from, a toner container and capable of covering an opening of the toner container, the cover having an outlet formed for communication with the inside of the toner container, and a valve element capable of closing the outlet, wherein the valve element can be shifted to an open position by being pressed up by a pressing-up portion on the developing apparatus side, so that the toner can be supplied from the toner container to the developing apparatus. Because the auxiliary device for toner supply of the present invention is attachable to, and detachable from, the toner container, it can be reused on a new toner container even after disposal of the used toner container, and is therefore economical. Preferably the cover has a pipe-shaped guide extending outwardly from the periphery of the outlet thereof, the valve element has a pipe-shaped chute inserted in the guide, the chute has a toner introduction port formed therein, and the chute is pressed up by inserting the pressing-up portion, which has a pipe-shape and constitutes a toner supply port on the developing apparatus side, into the guide to shift the toner introduction port to a position for communication between the inside and outside of the toner container, so that the toner introduced in the chute via the toner introduction port from the toner container can be fed to the toner supply port.

A cartridge for toner supply to a developing apparatus according to the present invention comprises a toner container, a valve element capable of closing an outlet formed for communication with the inside of the toner container, a pipe-shaped guide extending outwardly from the periphery of the outlet, the valve element having a pipe-shaped chute inserted in the guide, the chute having a toner introduction port formed therein, wherein the chute is pressed up by inserting a pipe-shaped pressing-up portion, which constitutes a toner supply port on the developing apparatus side, into the guide to shift the toner introduction port to a position for communication between the inside and outside of the toner container, so that the toner introduced in the chute via the toner introduction port from the toner container can be fed to the toner supply port. According to the cartridge for toner supply of the present invention, toner can be supplied to the developing apparatus solely by inserting the pressing-up portion into the guide, so that no troublesome operation is required. Besides, the valve element is pressed up surely by the pressing-up portion, so that toner can be fed to the toner supply port without failure. Furthermore, when the used toner container is removed from the developing apparatus, the toner remaining in the toner container is prevented from spilling because the outlet is closed by the valve element. In addition, since the pressing-up portion constitutes the toner supply port, there is no need of a dedicated element for pressing up the valve element, so that the structure can be simplified. Preferably the cartridge for toner supply of the present invention comprises an auxiliary device for toner supply having a cover attachable to, and detachable from, the toner container and capable of covering an opening of the toner container, and the valve element, wherein the outlet and the guide are formed in the cover. According to this arrangement the cartridge of the present invention can be configured by attaching the auxiliary device to a toner container.

Preferably, in the auxiliary device and cartridge for toner supply of the present invention, the valve element has a main body capable of coming in contact with, and breaking contact with, the periphery of the outlet, from the main body the chute extends, there are means of reversibly bringing the main body into contact with the periphery of the outlet, and the outlet is closed by the valve element upon contact of the main body with the periphery of the outlet. According to this arrangement, when the valve element is at the closure position, toner leakage from the toner container is prevented without failure. Further, it is preferable that the valve element has a main body capable of coming in contact with, and breaking contact with, the periphery of the outlet, from the main body the chute extends, the main body and the toner introduction port are arranged at a distance in the axial direction, and the radial gap between the outer circumference of the chute and the inner circumference of the guide is sufficiently narrow to seal the toner container over the axial distance between the main body and the toner introduction port. By this arrangement, the toner is not discharged, unless the valve element is pressed up by the distance in the axial direction between the main body and the toner introduction port, so that toner leakage from the toner container is prevented certainly when the valve element is at the closure position.

According to the first aspect of the present invention relating to an apparatus for toner supply, the apparatus comprises an auxiliary device for toner supply; a restraint element provided on the developing apparatus side; the auxiliary device having a cover attachable to, and detachable from, a toner container and capable of covering an opening of the toner container, a valve element capable of closing an outlet formed for communication with the inside of the toner container, and means for reversibly retaining the valve element at a closure position of the outlet; the valve element being able to be inserted in, and drawn out from, a toner supply port on the developing apparatus side; and the restraint element being able to be engaged and disengaged with the valve element inserted in the toner supply port; wherein the restraint element engaged with the valve element restrains the extraction of the valve element from the toner supply port, and the valve element is shifted to an open position by pulling up the toner container with respect to the valve element engaged with the restraint element, so that the toner can be supplied from the toner container to the developing apparatus. By this arrangement, since the auxiliary device is attachable to, and detachable from, the toner container, it can be reused on a new toner container even after disposed of the used toner container, and is therefore economical. Besides, since the valve element can be incorporated in the cover detached from the toner container, assembly is easy.

According to the second aspect of the present invention relating to an apparatus for toner supply, the apparatus comprises a toner container, a valve element capable of closing an outlet formed for communication with the inside of the toner container, means for reversibly retaining the valve element at a closure position of the outlet, a restraint element provided on the developing apparatus side, the valve element being able to be inserted in, and drawn out from, a toner supply port on the developing apparatus side, and the restraint element being able to be engaged and disengaged with the valve element inserted in the toner supply port, wherein the restraint element engaged with the valve element restrains the extraction of the valve element from the toner supply port, and the valve element is shifted to an opening position by pulling up the toner container with respect to the valve element engaged with the restraint element, so that the toner can be supplied from the toner container to the developing apparatus. By this arrangement, since toner can be supplied to the developing apparatus solely by pulling up the toner container after the restraint element is engaged with the valve element inserted in the toner supply port, so that no troublesome operation is required. Besides, the extraction of the valve element from the toner supply port is restrained during toner supply, so that the toner is prevented from leaking from the toner supply port. Preferably the apparatus for toner supply according to the second aspect of the present invention comprises an auxiliary device for toner supply having a cover attachable to, and detachable from, the toner container and capable of covering an opening of the toner container, the valve element, and the means for reversibly retaining the valve element at the closure position of the outlet. By this arrangement, the apparatus for toner supply according to the second aspect of the present invention can also have the above-described features of the auxiliary device, and is therefore economical.

Preferably the apparatus for toner supply of the present invention comprises a pipe-shaped guide whose inner circumference forms the outlet; the valve element having a lid, which is capable of coming in contact with, and breaking contact with, the periphery of the outlet, and a pipe-shaped chute, which extends from the lid and is inserted in the guide; the chute having a toner run-off port formed therein; and the restraint element being able to be shifted to the positions for engagement and disengagement with the lid; wherein the toner run-off port is shifted to a position for communication between the inside and outside of the toner container by pulling up the toner container at the time of engagement of the restraint element with the lid, so that the toner can be fed from the toner container to the toner supply port via the toner run-off port. By this arrangement, when the valve element is at the closure position, toner leakage from the toner container is prevented certainly. Further, it is preferable that the lid and the toner run-off port are arranged at a distance in the axial direction, and the radial gap between the outer circumference of the chute and the inner circumference of the guide is sufficiently narrow to seal the toner over the axial distance between the lid and the toner run-off port. By this arrangement, the toner is not discharged, unless the valve element is pressed up by the distance in the axial direction between the lid and the toner run-off port, so that toner leakage from the toner container is prevented certainly when the valve element is at the closure position. Furthermore, it is preferable that the restraint element has a claw shiftable in the lid's radial direction, and the extraction of the valve element from the toner supply port is restrained by overlapping the lid and the claw with respect to the axial direction. By this arrangement, the extraction of the valve element from the toner supply port during toner supply is prevented certainly.

DETAILED DESCRIPTION OF PREFERRED EMBODIMENTS

The first embodiment of the present invention is hereinafter described with reference to FIGS. 1A through 5.

Figure 1C:
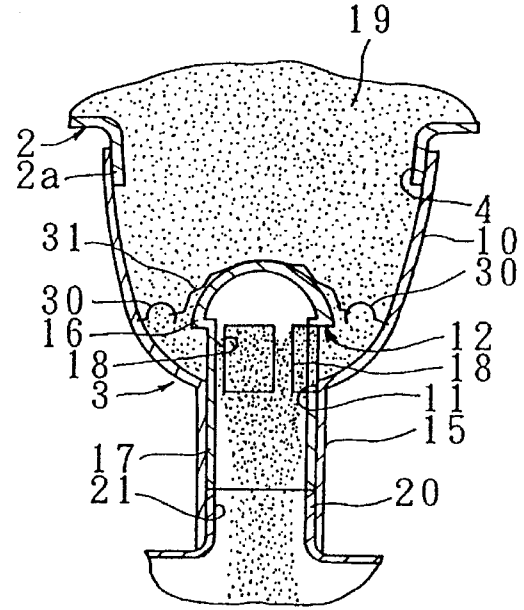
FIG. 1C is a cross-sectional view of the apparatus for toner supply of the first embodiment during toner supply.
Figure 1B:
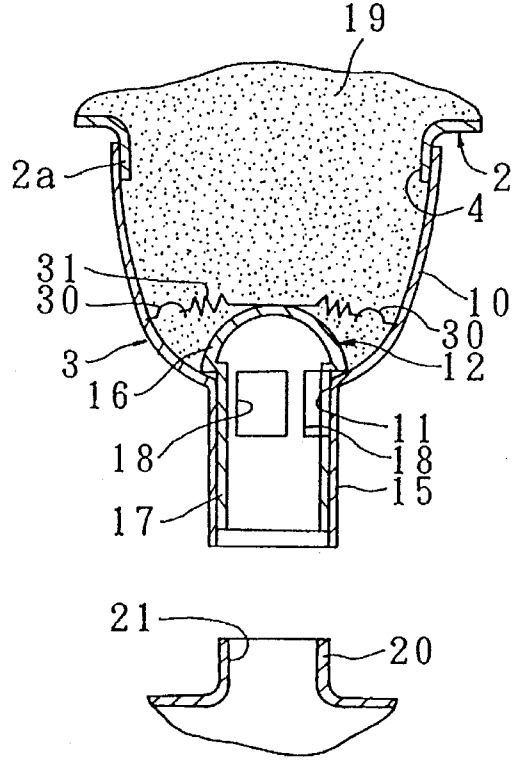
FIG. 1B is a cross-sectional view of the apparatus for toner supply of the first embodiment before toner supply.
Figure 1A:
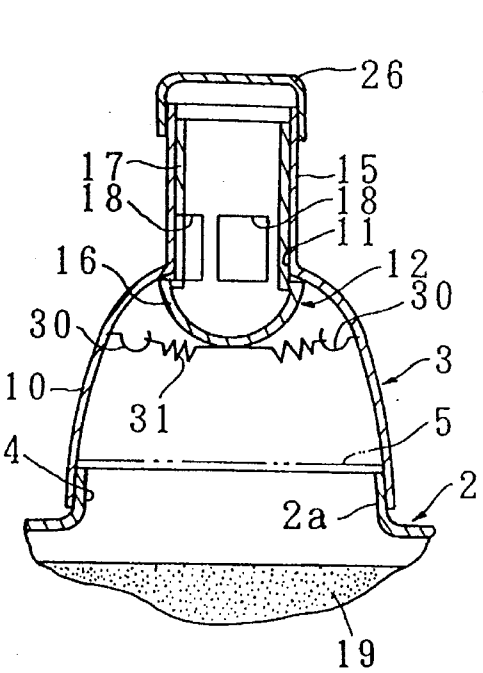
FIG. 1A is a cross-sectional view of the apparatus for toner supply of the first embodiment of the present invention in a storage condition.
Figure 4:
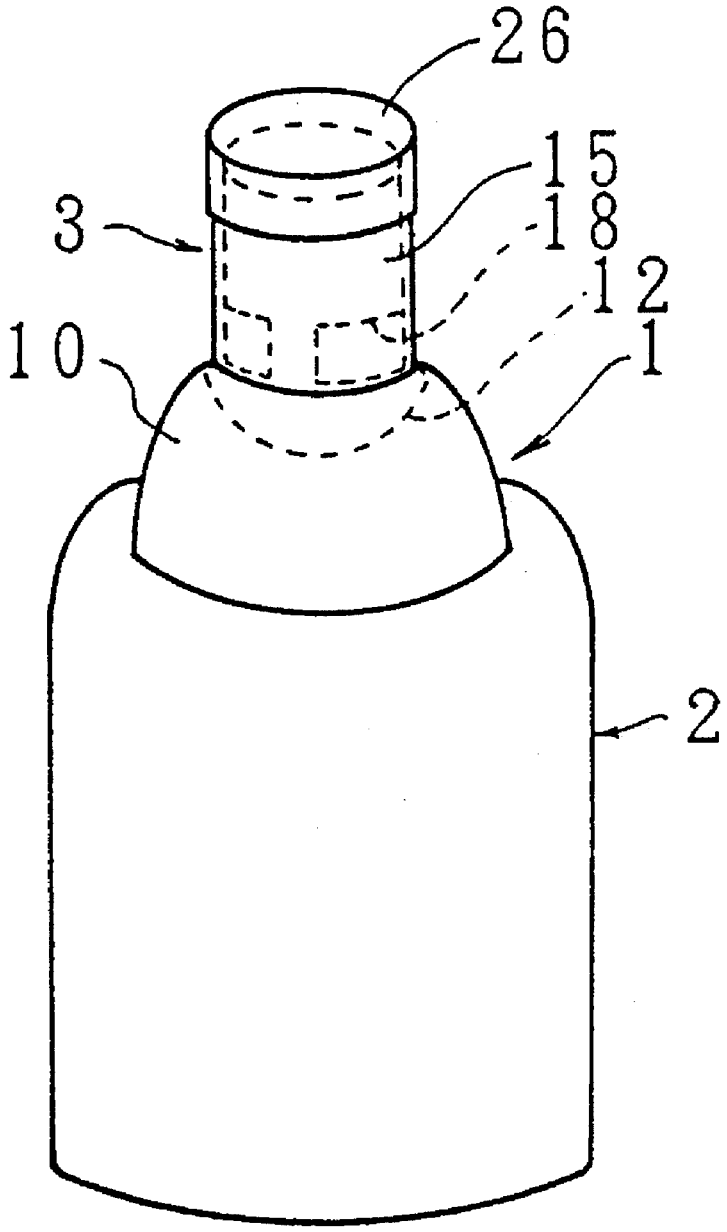
FIG. 4 is a perspective view of the toner cartridge of the first embodiment.

The toner cartridge 1 illustrated in FIG. 4 comprises a toner container 2 and an auxiliary device for toner supply 3. In the upper portion of the toner container 2, as shown in FIG. 1A, a ring-shaped auxiliary device connector 2*a* and an opening 4 surrounded by the connector 2*a* are formed. The opening 4 is sealed by a sealing element 5 (indicated by two-dot chain line in FIG. 1A) removably stuck to the connector 2*a*.

Figure 2:
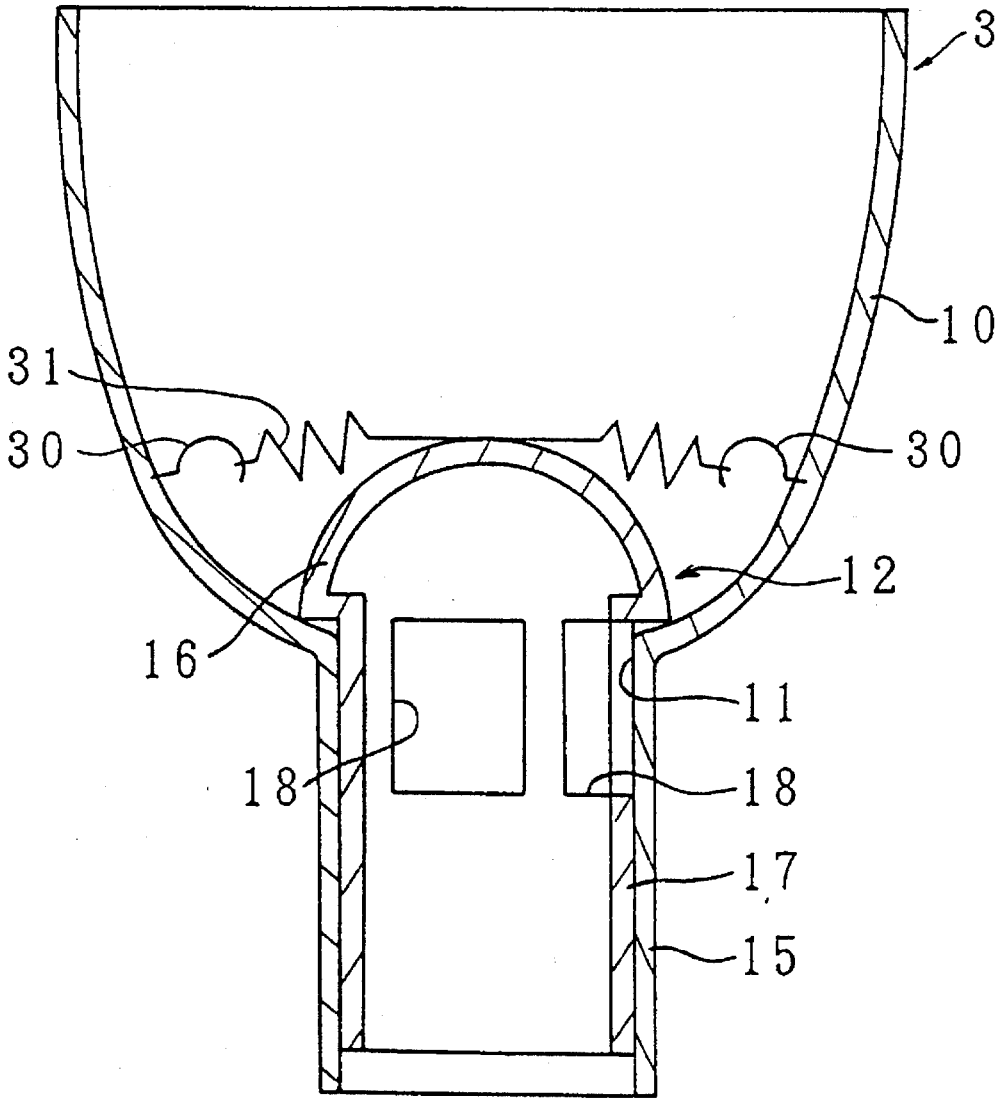
FIG. 2 is a cross-sectional view of the auxiliary device for toner supply of the first embodiment.

As shown in FIGS. 1A and 2, the auxiliary device for toner supply 3 comprises a cover 10 which covers the opening 4 of the toner container 2, and a valve element 12 capable of closing an outlet 11 formed for communication with the inside of the toner container 2. The cover 10 has a pipe-shape, and its diameter decreases from one end side (lower side in FIG. 1A, upper in FIG. 2) to the other end side (upper side in FIG. 1A, lower in FIG. 2). The inner circumference of the one end of the cover 10 is detachably fitted into the outer circumference of the above-described connector 2*a*. The cover 10 and the connector 2*a* may be fitted together via screws. At the other end of the cover 10 is formed the outlet 11. From the periphery of the outlet 11, a cylindrical guide 15 extends toward the outside (toward upper in FIG. 1A, lower in FIG. 2) of the cover 10. The tip of the guide 15 is covered by a cap 26 as shown in FIG. 1A.

Figure 3:
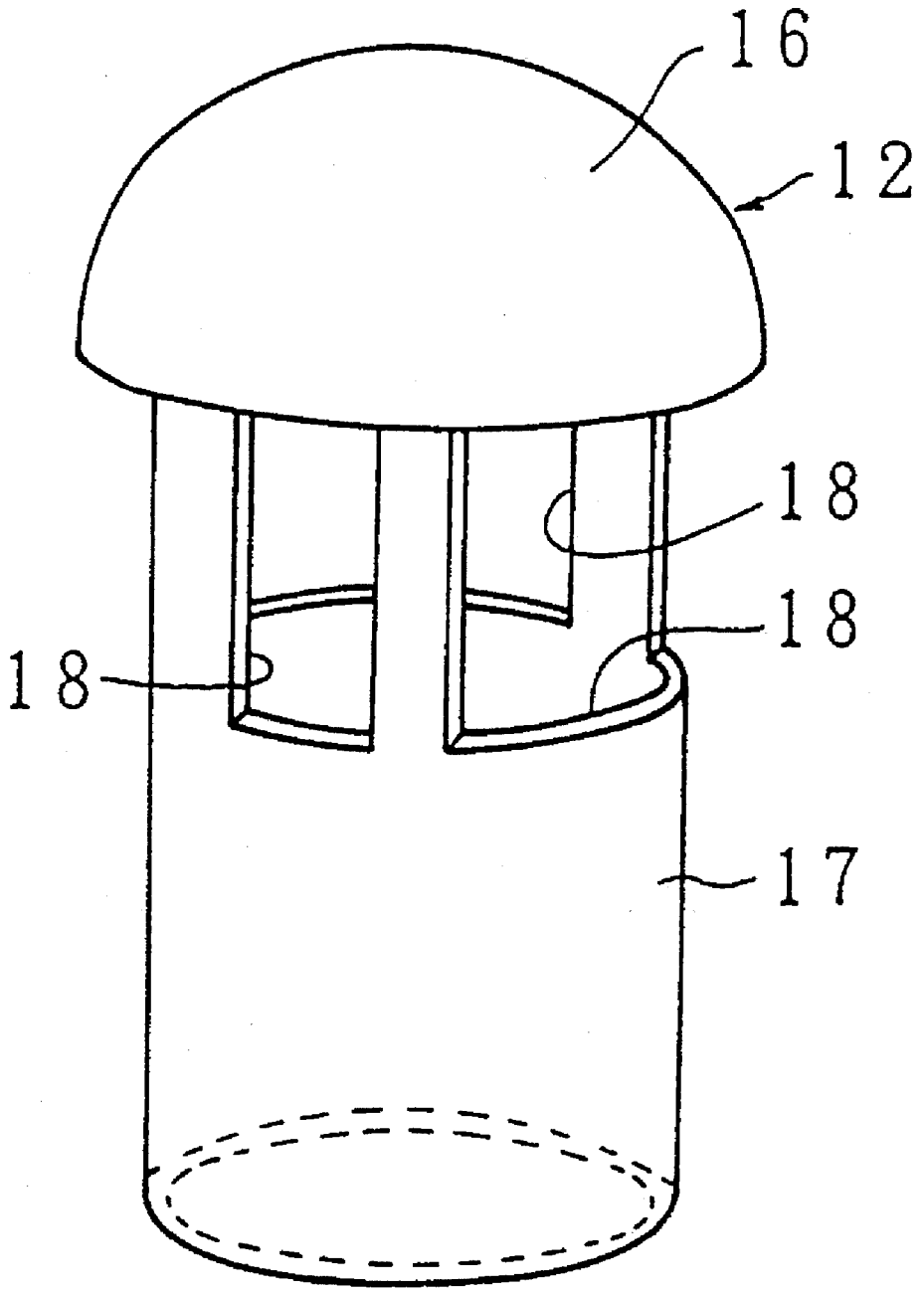
FIG. 3 is a perspective view of the valve element of the first embodiment.

As shown in FIGS. 1A, 2 and 3, the valve element 12 has a hollow semi-spherical main body 16 and a cylindrical chute 17 extending from the end face of the main body 16. The outer periphery margin of the end face of the main body 16 has a diameter larger than that of the outlet 11. The chute 17 is inserted into the above-described guide 15 so that it is movable in the axial direction. As the chute 17 moves reciprocally in the axial direction on the guide 15, the outer periphery margin of the main body 16 in the cover 10 comes in contact with, and breaks contact with, the periphery of the outlet 11. To reversibly bring the main body 16 into contact with the periphery of the outlet 11, a spring 31 is suspended on a pair of hooks 30 attached to the inside of the cover 10. While the outer periphery margin of the main body 16 is being pressed against the periphery of the outlet 11 by the elastic force of the spring 31, the outlet 11 is closed by the valve element 12. A number of toner introduction ports 18 through the chute 17 are formed adjacent to the main body 16. Each toner introduction port 18 is arranged at a position opposite to the outlet 11. The radial gap between the outer circumference of the chute 17 and the inner circumference of the guide 15 is sufficiently narrow to seal toner 19, so that the toner 19 is prevented from leaking from the gap.

A pressing-up portion 20 for pressing up the valve element 12 to an open position of the outlet 11 is provided in the developing apparatus. Specifically, as shown in FIG. 1B, the pressing-up portion 20 is cylindrical and constitutes a toner supply port 21 of the developing apparatus. As shown in FIG. 1C, as the guide 15 is shifted downwards toward the pressing-up portion 20 with the guide's tip downwards, the pressing-up portion 20 is inserted in the guide 15, and the chute 17 is pressed up against the elastic force of the spring 31. As the chute 17 is pressed up, the outer periphery margin of the main body 16 breaks contact with the periphery of the outlet 11, and the valve element 12 is shifted to the opening position of the outlet 11. As the chute 17 is pressed up, the above-described toner introduction port 18 is shifted into the cover 10, resulting in communication between the inside and outside of the toner container 2, so that the toner 19, which is introduced from the toner container 2 to the chute 17 via the toner introduction port 18, can be fed to the toner supply port 21. The radial gap between the outer circumference of the pressing-up portion 20 and the inner circumference of the guide 15 is sufficiently narrow to seal the toner 19, so that the toner 19 is prevented from leaking from the gap.

To supply the toner 19 to the developing apparatus according to the above-described configuration, the sealing element 5 closing the opening 4 of the toner container 2 is first removed. Next, the cover 10 of the auxiliary device for toner supply 3 is fitted into the connector 2*a* of the toner container 2, to constitute a toner cartridge 1. Next, the cap 26 closing the tip of the guide 15 of the auxiliary device for toner supply 3 is removed, the guide 15 is shifted downwards toward the pressing-up portion 20 of the developing apparatus with the guide's tip downwards, and the pressing-up portion 20 is inserted in the guide 15. As a result, the chute 17 of the valve element 12 is pressed up and the toner 19, which is introduced from the toner container 2 to the chute 17 via the toner introduction port 18, is fed to the toner supply port 21.

According to the above-described configuration of the first embodiment, the auxiliary device for toner supply 3 is attachable to, and detachable from, the toner container 2, so that it can be reused on a new toner container even after disposal of the used toner container 2, and is therefore economical. Also, it is easy to incorporate the valve element 12, hook 30 and spring 31 in the cover 10, because the incorporation can be achieved while the cover 10 is not on the toner container 2. Further, a toner can be supplied to the developing apparatus solely by inserting the pressing-up portion 20 in the guide 15 and pressing up the valve element 12, so that no troublesome operation is required. It is also possible to press up the valve element 12 by the pressing-up portion 20 to allow the toner to be fed to the toner supply port 21. In addition, since the pressing-up portion 20 constitutes the toner supply port 21, it is unnecessary to provide a dedicated element in the developing apparatus for pressing up the valve element 12, so that the structure of the toner supply port 21 does not become complex. Besides, the toner 19 remaining in the toner container 2 does not spill, because the valve element 12 shifts by the elastic force of the spring 30 to close the outlet 11 when the toner cartridge 1 is removed from the developing apparatus.

The above-described guide, chute and pressing-up portion are not limited to cylinders; for example, they may have a prismatic pipe-shape.

Figure 5:
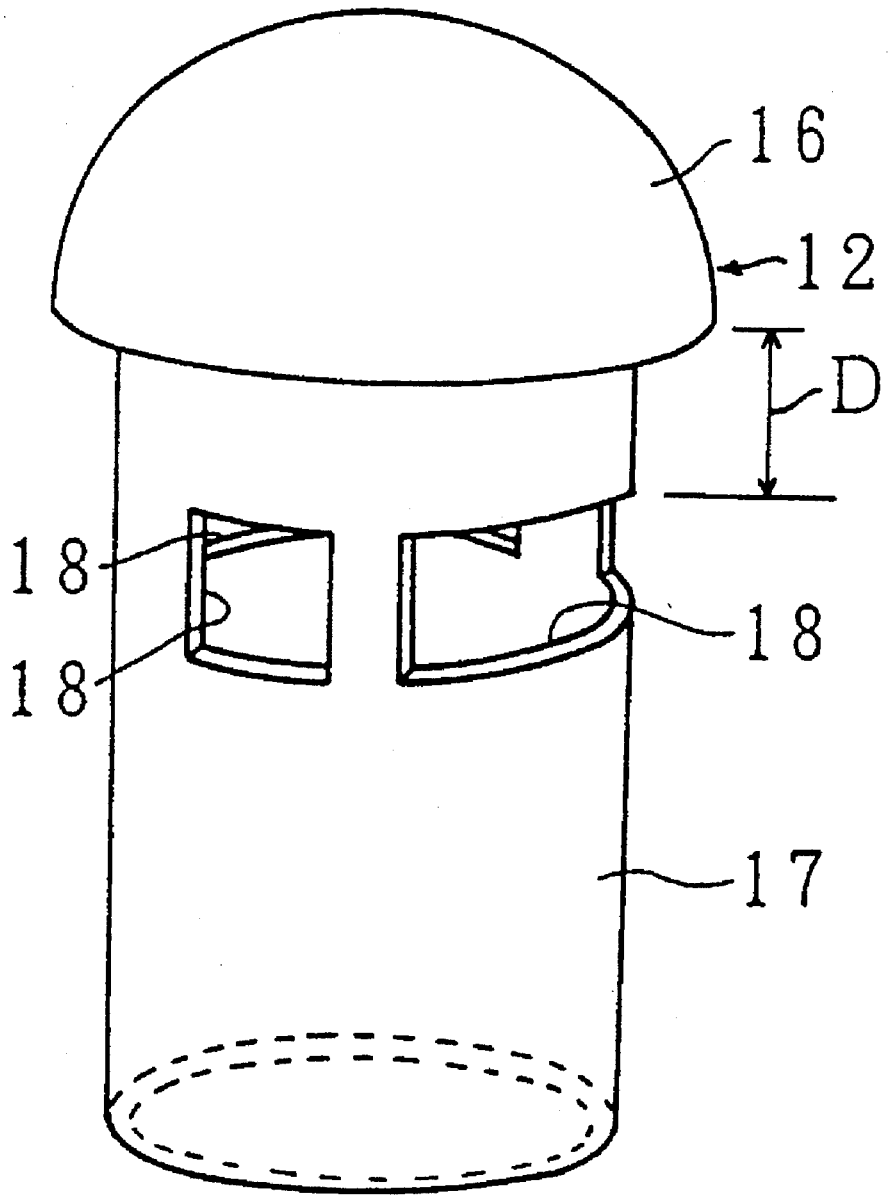
FIG. 5 is a perspective view of the valve element of the first modification of the first embodiment.
Figure 6:
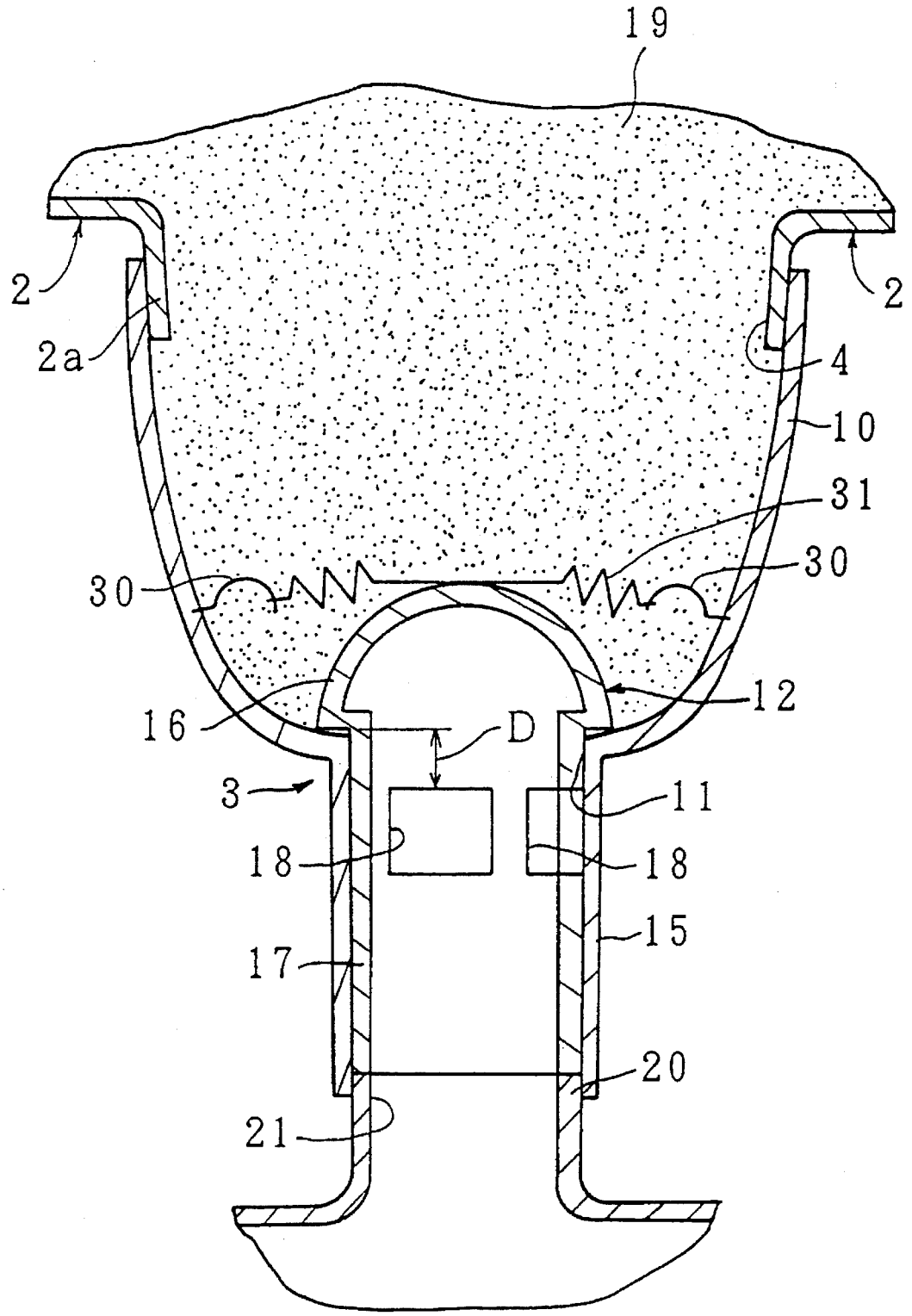
FIG. 6 is a cross-sectional view for explanation of the apparatus for toner supply of the first modification of the first embodiment.

FIGS. 5 and 6 show the first modification of the above-described first embodiment. The first modification differs from the first embodiment in that the main body 16 and toner introduction port 18 of the valve element 12 are arranged at a distance D in the axial direction, and that the radial gap between the outer circumference of the chute 17 and the inner circumference of the guide 15 over the distance D is sufficiently narrow to seal the toner 19. The other aspects of the configuration in the first modification are the same as in the first embodiment. Leakage of the toner 19 is thus prevented without failure, because the toner 19 is not discharged unless the valve element 12 is pressed up by the axial distance D.

Figure 7A:
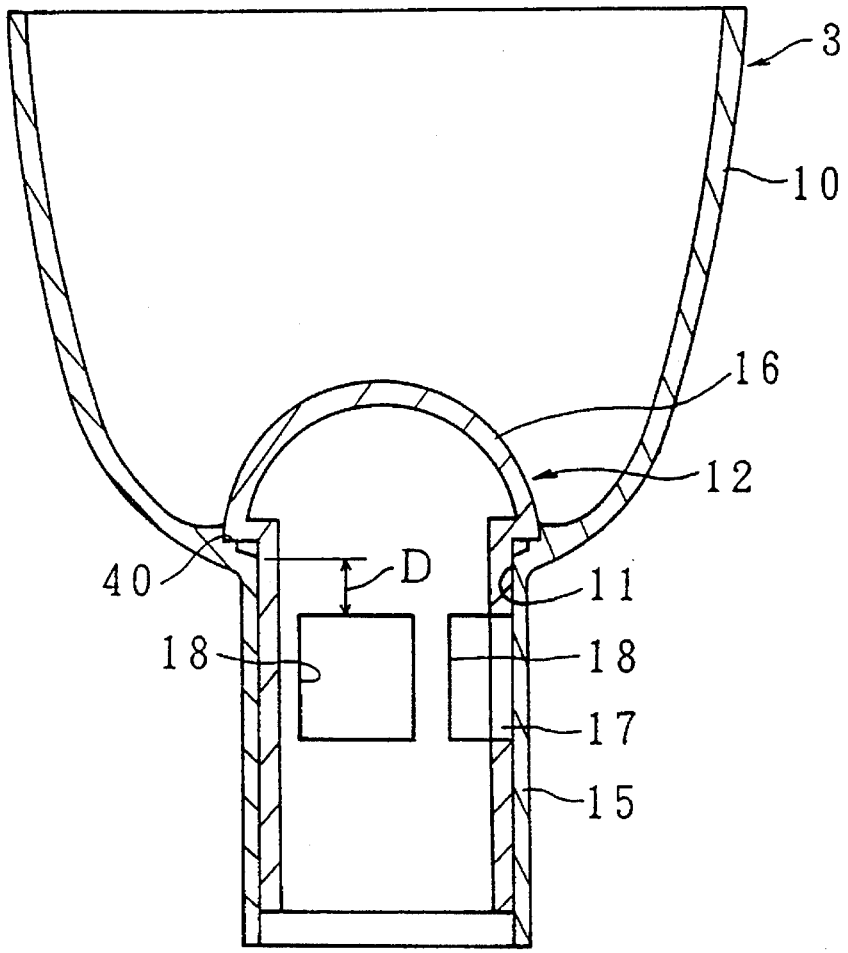
FIG. 7A is a cross-sectional view of the auxiliary device for toner supply of the second modification of the first embodiment.
Figure 7B:
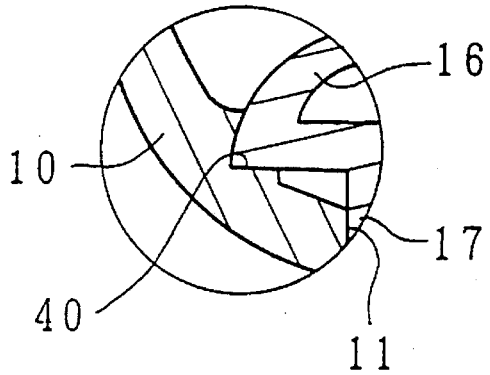
FIG. 7B is a partially magnified view of FIG. 7A.

FIGS. 7A and 7B show the second modification of the above-described first embodiment. The second modification differs from the first embodiment in that a ring-shaped concavity 40 is formed around the outlet 11 of the cover 10. The cover 10 is made of a material such as an elastic synthetic resin; as the portion around the concavity 40 is elastically deformed, the outer periphery margin of the main body 16 of the valve element 12 is pressed in the concavity 40. As a result, extraction of the valve element 12 from the cover 10 is prevented and the outlet 11 is closed without failure, so that leakage of the toner 19 from the container 2 during transportation of the cartridge 1 is prevented without failure. Also, when the chute 17 is pressed up by the pressing-up portion 20, the portion around the concavity 40 is elastically deformed and the main body 16 is detached from the concavity 40, resulting in a shift of the valve element 12 to the opening position of the outlet 11. Since the pressed up valve element 12 can fall by gravity when the toner cartridge 1 is removed from the developing apparatus, the hook 30 and spring 31 as in the first embodiment is not provided. In addition, as in the above-described first modification, the main body 16 and the toner introduction port 18 are arranged at a distance D in the axial direction, and the toner 19 is not discharged, unless the valve element 12 is pressed up by the axial distance D. When the auxiliary device 3 according to the second modification is reused, the outer periphery margin of the main body 16 is again pressed in the concavity 40. The other aspects of configuration in the second modification are the same as in the first embodiment.

Figure 8A:
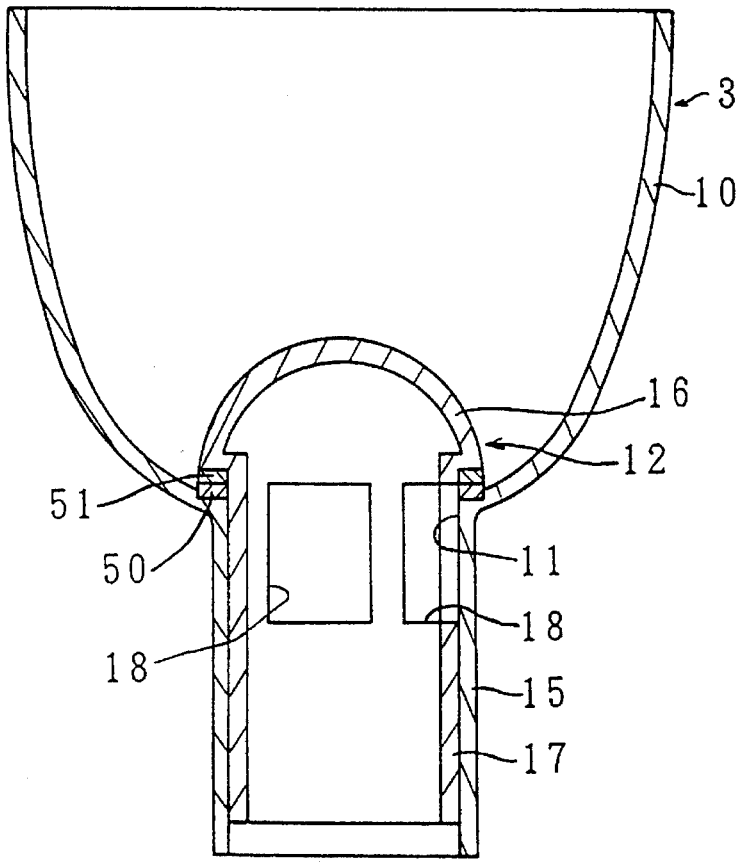
FIG. 8A is a cross-sectional view of the auxiliary device for toner supply of the third modification of the first embodiment.
Figure 8B:
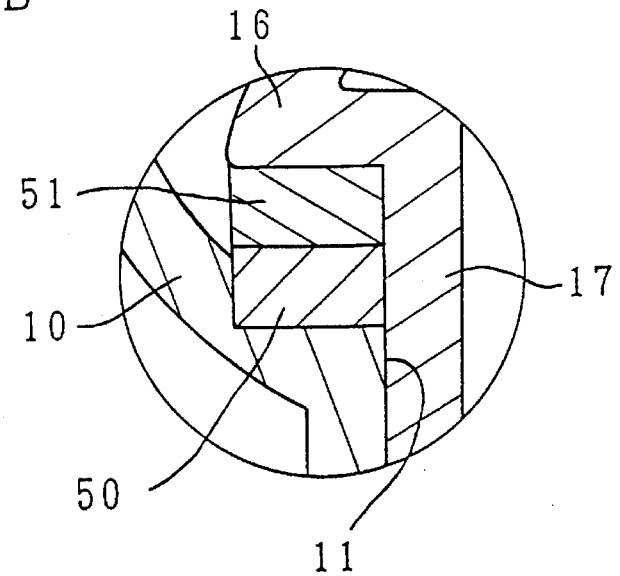
FIG. 8B is a partially magnified view of FIG. 8A.

FIGS. 8A and 8B show the third modification of the first embodiment. The third modification differs from the first embodiment in that a ring 50 is attached to the portion around the outlet 11 and a ring 51 is attached to the end face of the main body 16 of the valve element 12. At least one of the rings 50 and 51 is a permanent magnet, and the other may be a permanent magnet or a magnetically attractable inorganic material. For example, one ring is made of a plastic magnet, and the other is made of a plastic material wherein a magnetic powder such as magnetite powder, ferrite powder or iron powder is dispersed. Mutual attraction of the rings 50 and 51 closes the outlet 11. As the chute 17 is pressed up by the pressing-up portion 20, the rings 50 and 51 break contact with each other to open the outlet 11. Since the pressed up valve element 12 can fall by gravitational and magnetic force, the hook 30 and spring 31 as in the first embodiment is not provided. The other aspects of the configuration in the third modification are the same as in the first embodiment.

Figure 9:
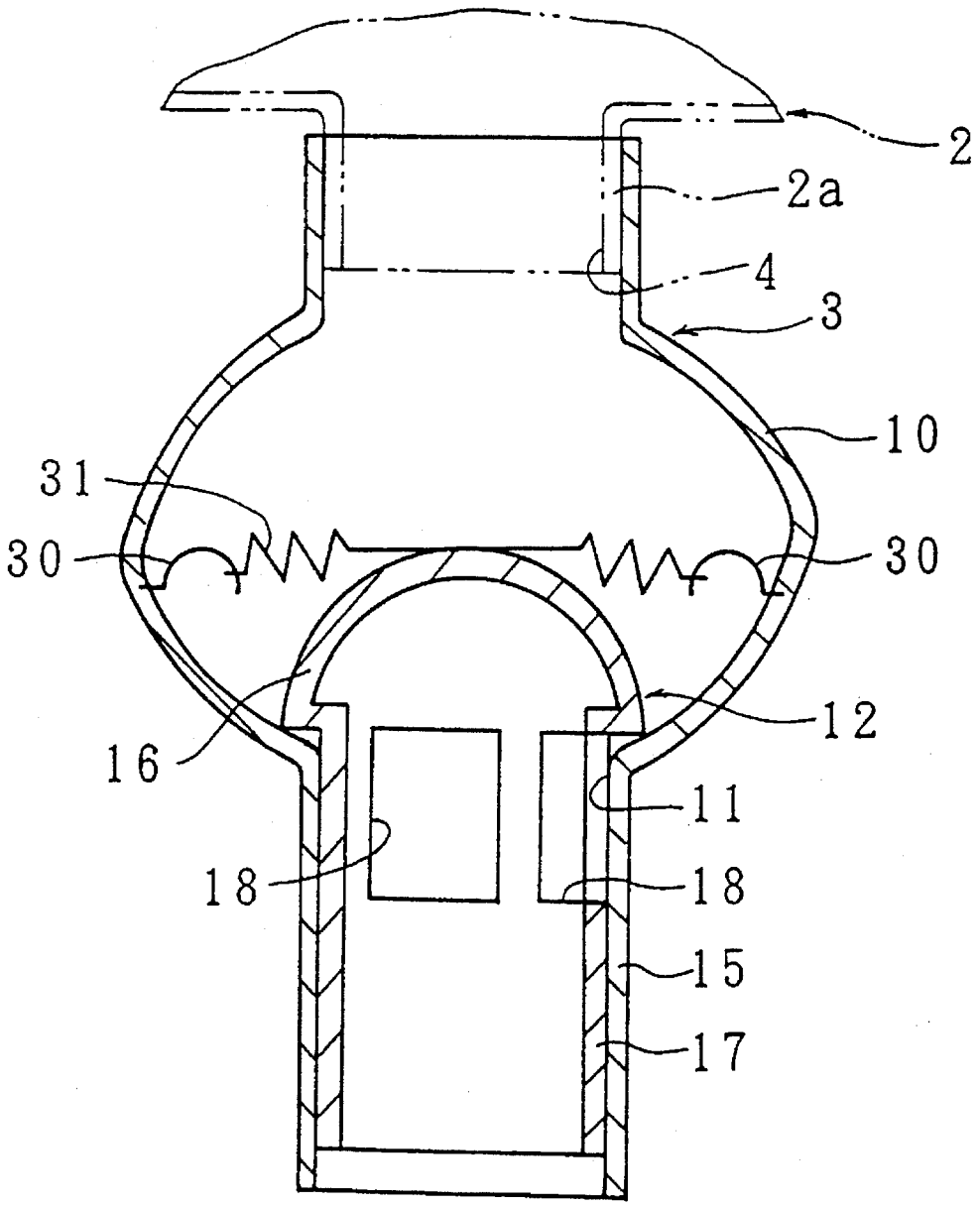
FIG. 9 is a cross-sectional view of the auxiliary device for toner supply of the fourth modification of the first embodiment.

FIG. 9 shows the fourth modification of the first embodiment. The fourth modification differs from the first embodiment in that the diameter of the cover 10 decreases from the center to both ends, so that the openings at respective ends have the same diameter, while the diameter decreases from one end to the other in the first embodiment. The other aspects of the configuration in the fourth modification are the same as in the first embodiment. Either of the two end openings of the cover 10 may be the outlet 11.

The second embodiment of the present invention is hereinafter described with reference to FIGS. 10A through 15. The toner cartridge 100 illustrated in FIG. 12 comprises an auxiliary device for toner supply 101 and a toner container 102. In the upper portion of the toner container 102 are formed, as shown in FIG. 11, a ring-shaped auxiliary device connector 102*b* and an opening 102*a* surrounded by the connector 102*b*. The opening 102*a* is sealed by a sealing element 108 (indicated by two-dot chain line in FIG. 11) removably stuck to the connector 102*b*.

As shown in FIG. 11, the auxiliary device for toner supply 101 has a cover 103, covering the opening 102*a* of the toner container 102, and a valve element 104. The auxiliary device 101 has an outlet 107 formed for communication with the inside of the toner container 102 via the opening 102*a*. The outlet 107 can be closed by the valve element 104.

The cover 103, made of an elastic synthetic resin, has a pipe-shape, and its diameter decreases from one end side (lower side in FIG. 11) to the other end side (upper side in FIG. 11). The inner circumference of the one end of the cover 103 is detachably fitted into the outer circumference of the above-described connector 102*b*. The cover 103 and the connector 102*b* may be fitted together via screws. From the periphery of an opening at the other end of the cover 103, a cylindrical guide 106 extends toward the outside (toward upper in FIG. 11) of the cover 103. The tip of the guide 106 forms a small-diameter portion 106*a*. The inner circumference of the guide 106 forms the above-described outlet 107. The tip of the guide 106 is covered by a cap 116.

Figure 13:
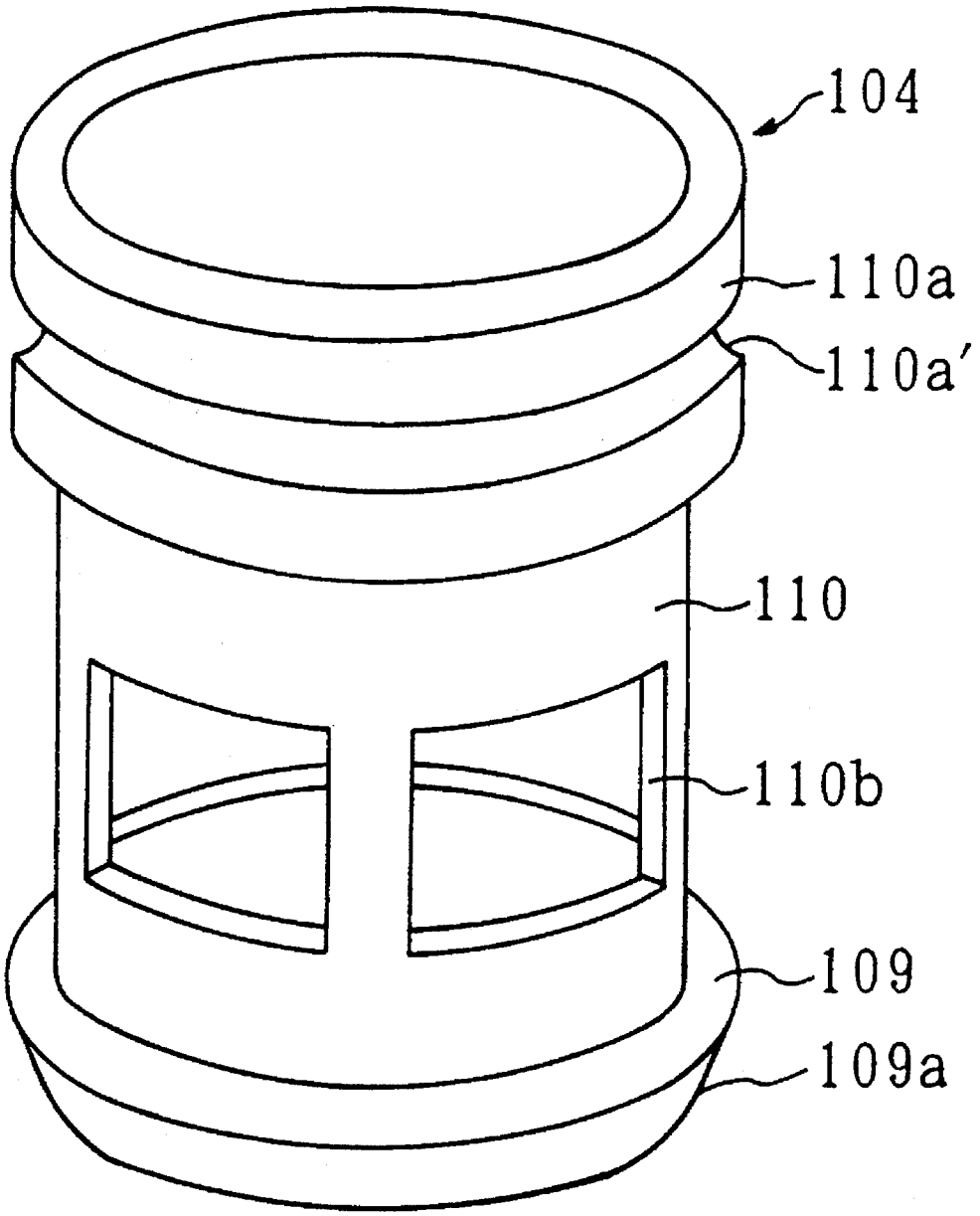
FIG. 13 is a perspective view of the valve element of the second embodiment.

The valve element 104, made of an elastic synthetic resin, has a disk-shaped lid 109 and a cylindrical chute 110 extending from the end face of the lid 109 as shown in FIGS. 11, 13. The lid 109 has a diameter larger than that of the small-diameter portion 106a of the above-described guide 106, and the chute 110 is inserted in the guide 106 so that it is movable in the axial direction. As the chute 110 moves reciprocally in the axial direction on the guide 106, the end face of the lid 109 comes in contact with, and breaks contact with, the end face of the guide 106, i.e., the periphery of the outlet 107. As the end face of the lid 109 contacts the end face of the guide 106, the outlet 107 is closed. The outer circumference of the lid 109 forms a tapered face 109*a* whose diameter decreases toward the outside (upper side in FIG. 11) of the guide 106. A number of toner run-off ports 110*b* through the chute 110 are formed. The lid 109 and the toner run-off ports 110*b* are arranged at a distance in the axial direction. The radial gap between the outer circumference of the chute 110 and the inner circumference of the guide 106 is sufficiently narrow to seal the toner 117 over the axial distance between the lid 109 and the toner run-off ports 110*b*, to prevent leakage of the toner 117 from the gap when the outlet 107 is closed with the valve element 104.

In the chute 110 of the valve element 104, the end opposite to the lid 109 forms a large-diameter portion 110*a*, and a circumferential groove 110*a'* is formed around the outer circumference of the large-diameter portion 110*a*. A pair of ring-shaped protrusions 106*b* and 106*c* are formed at a distance in the axial direction on the inner circumference of the guide 106. Each of the ring-shaped protrusion 106*b* and 106*c* can be fitted into the circumferential groove 110*a'*, and this fitting restricts the axial movement of the valve element 104 on the guide 106. When a given axial force is exerted on the valve element 104 whose axial movement is restricted by the fitting, the valve element 104 and the guide 106 are elastically deformed, which makes it possible to extract each of the ring-shaped protrusions 106*b* and 106*c* from the circumferential groove 110*a'*. While one ring-shaped protrusion 106*b* is fitted into the circumferential groove 110*a'*, the end face of the lid 109 comes in contact with the end face of the guide 106 forming the periphery of the outlet 107 to close the outlet 107, i.e., the valve element 104 is retained at the closure position of the outlet 107. When the other ring-shaped protrusion 106*c* is fitted into the circumferential groove 110*a'*, the end face of the lid 109 breaks contact with the end face of the guide 106, and the toner run-off ports 110*b* are shifted to the outside of the guide 106 for communication of the inside and outside of the toner container 102, i.e., the valve element 104 is retained at the opening position.

Figures 10A, 10B, 10C:
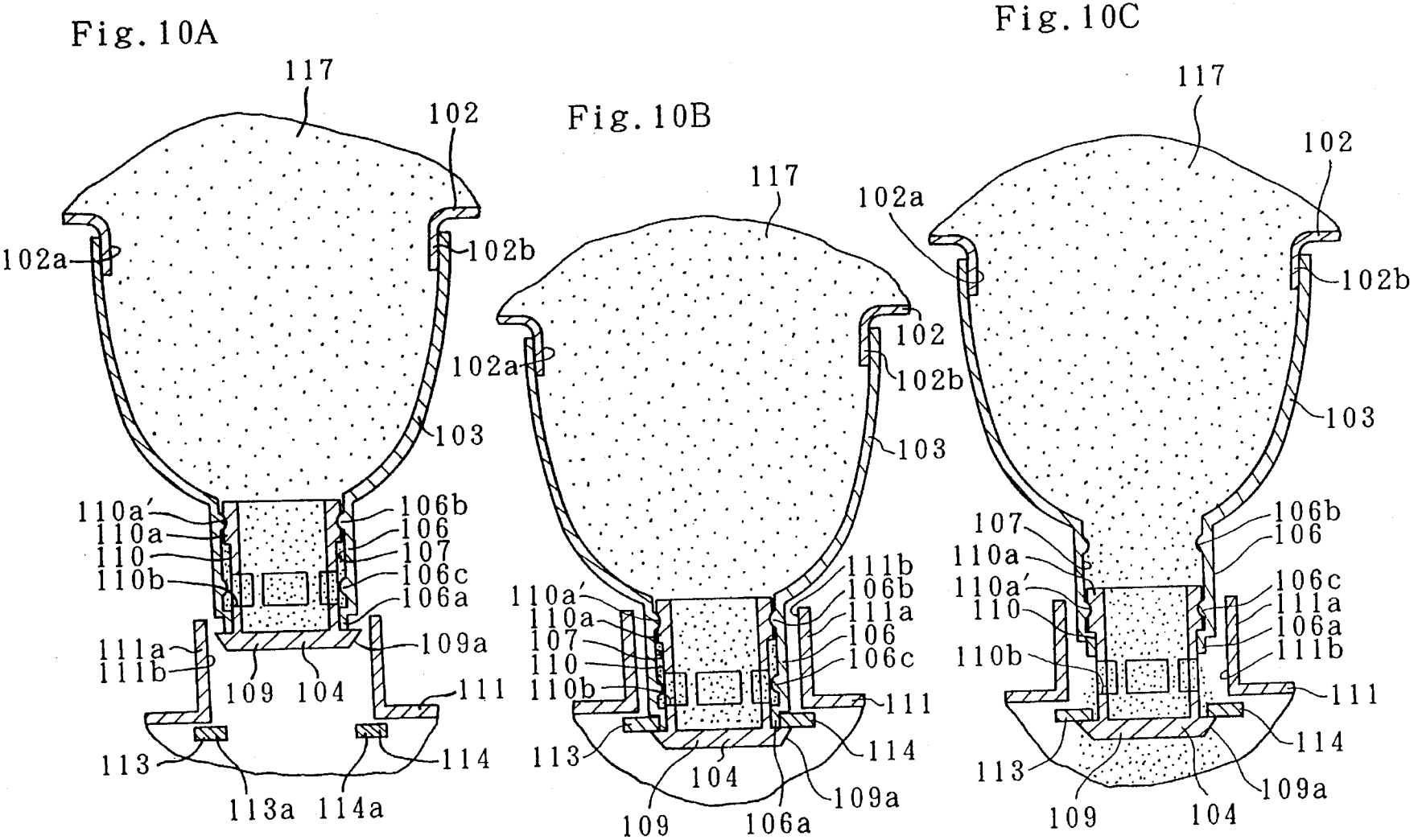
FIG. 10A is a cross-sectional view of the apparatus for toner supply of the second embodiment of the present invention before toner supply.
FIG. 10B is a cross-sectional view of the apparatus for toner supply of the second, embodiment after preparation for toner supply.
FIG. 10C is a cross-sectional view of the apparatus for toner supply of the second embodiment during toner supply.
Figure 11:
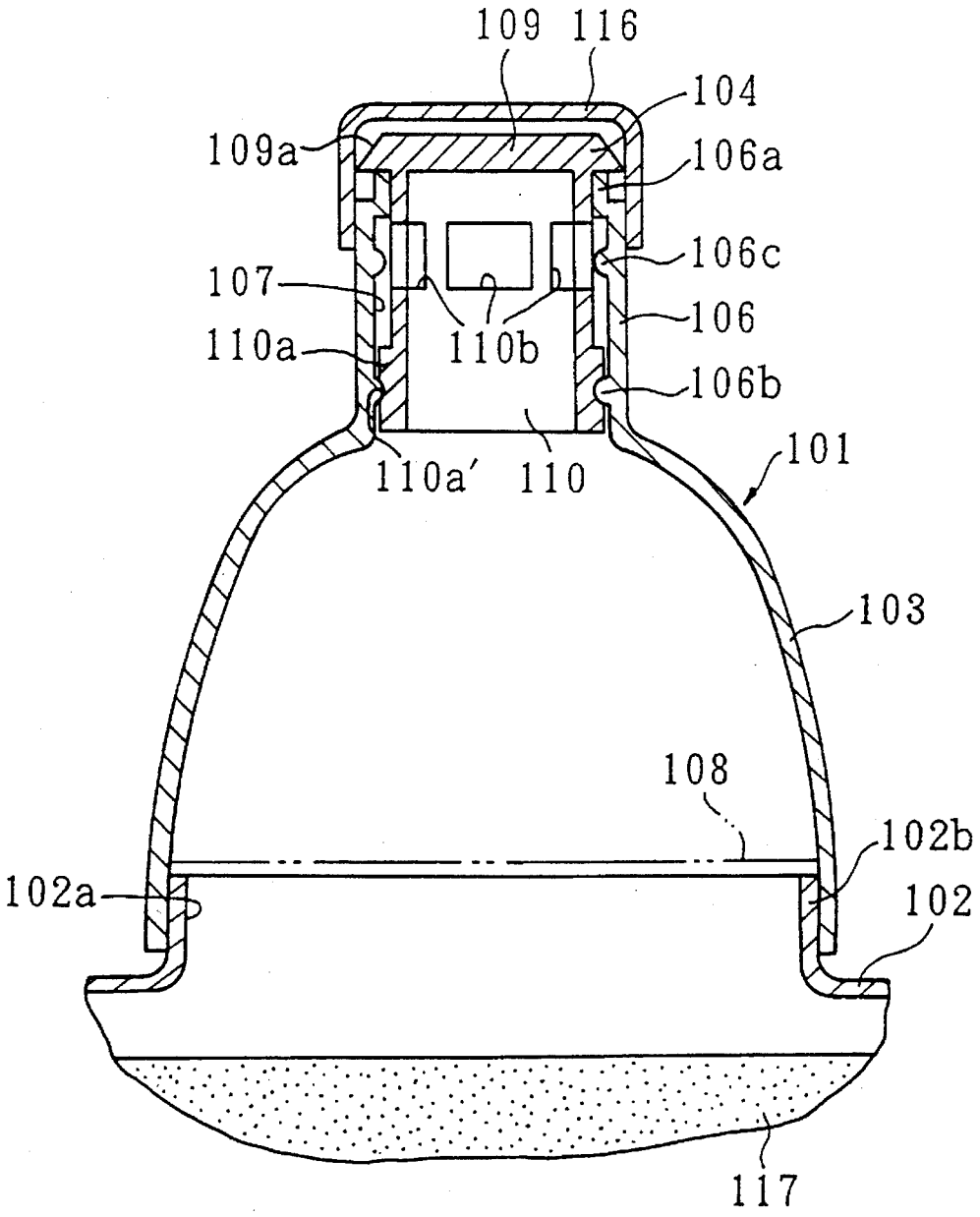
FIG. 11 is a cross-sectional view of the toner cartridge of the second embodiment.
Figure 12:
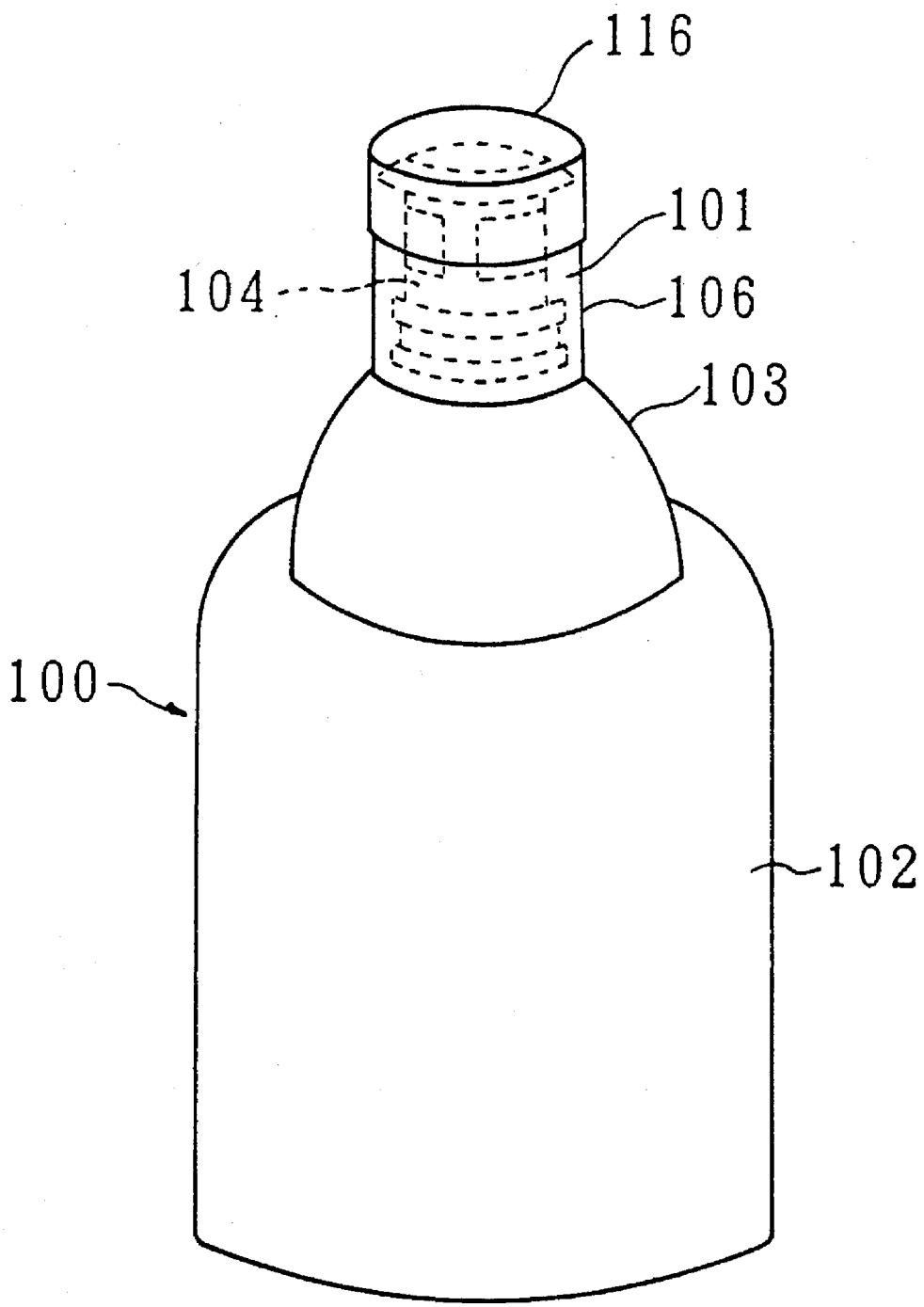
FIG. 12 is a perspective view of the toner cartridge of the second embodiment.

As shown in FIGS. 10A, 10B and 10C, the inner circumference of a pipe-shaped portion 111*a* extending upwardly from the toner storage tank 111 of the developing apparatus constitutes a toner supply port 111*b*. A valve element 104 and a guide 106 can be inserted to, and drawn out from, the toner supply port 111*b*. A restraint element provided on the developing apparatus side can be engaged and disengaged With the valve element 104 inserted in the toner supply port 111*b*.

Figure 14B:
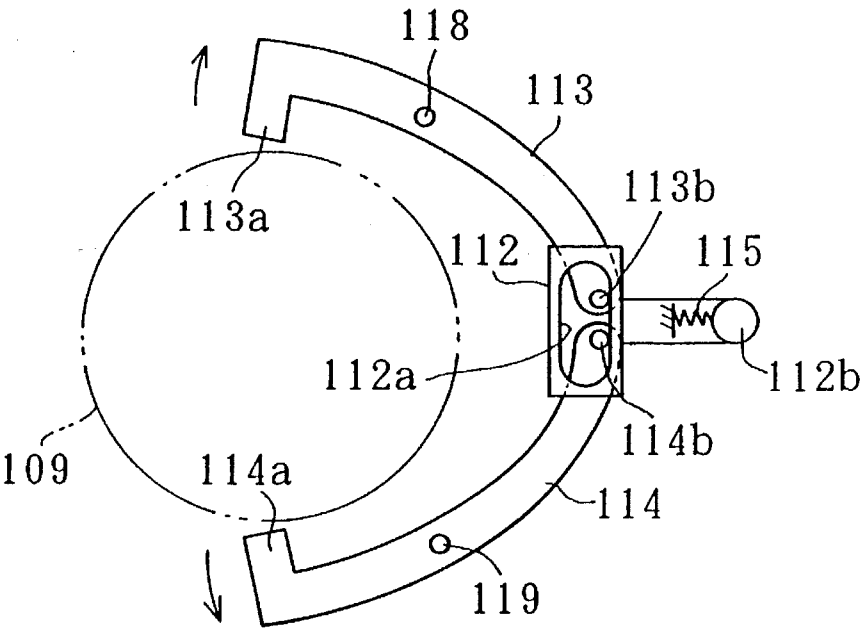
FIG. 14B is a plan view of the restraint element of the second embodiment in a derestricted condition.
Figure 14A:
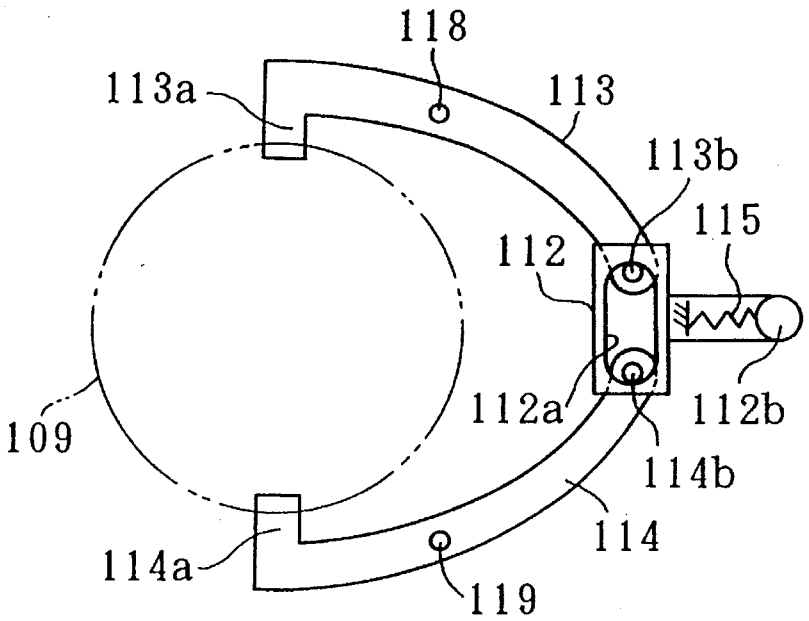
FIG. 14A is a plan view of the restraint element of the second embodiment in a restrained condition.
Figure 15:
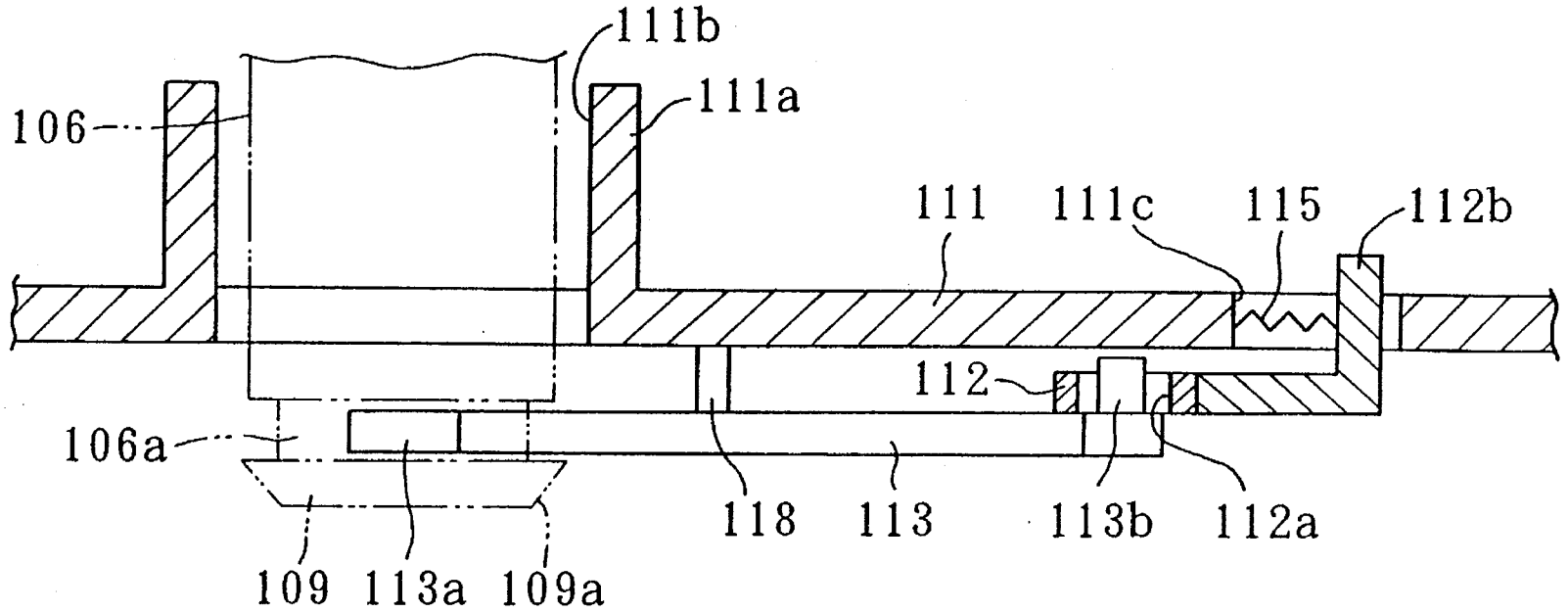
FIG. 15 is a cross-sectional view of the restraint element of the second embodiment.

As shown in FIGS. 14A, 14B and 15, the restraint element is configured with a pair of arms 113 and 114 arranged in the toner storage tank 111. Each of the arms 113 and 114 is supported rotatably by the toner storage tank 111 around vertical axis via supporting shaft 118 or 119 respectively. At one end of each of arms 113 and 114 is formed a claw 113*a* or 114*a;* at the other end is formed an upward protrusion 113*b* or 114*b*. The two claws 113*a* and 114*a* are arranged under the toner supply port 111*b*. The two upward protrusion 113*b* and 114*b* are inserted in a long hole 112*a* formed in a guide plate 112. The guide plate 112 has an L-shaped knob 112*b* whose end protrudes out of the toner storage tank 111 via a long hole 111*c*. A spring 115 is provided to force the knob 112*b* to the right direction in FIGS. 14A, 14B and 15 to widen the distance between both protrusion 113*b* and 114*b*.

When the knob 112*b* is pressed to the left in FIGS. 14A, 14B and 15 to narrow the distance between the both protrusion 113*b* and 114*b* against the elastic force of the spring 115, the arms 113 and 114 rotate around the supporting shafts 118 and 119 respectively. This rotation causes the two claws 113*a* and 114*a* to be shifted to mutually opposite directions, as indicated by the arrows in FIG. 14B. When the knob 112*b* is freed from the pressure, the claws 113*a* and 114*a* approach to each other by the elastic force of the spring 115, as shown in FIG. 14A. As shown in FIG. 14B, the distance between the claws 113*a* and 114*a* is larger than the diameter of the lid 109 of the valve element 104 when they are apart from each other. As shown in FIG. 14A, the distance between the claws 113*a* and 114*a* is smaller than the diameter of the lid 109 of the valve element 104 when they are close to each other. The claws 113*a* and 114*a* are both arranged radially outwardly of the small-diameter portion 106*a* of the guide 106 inserted in the toner supply port 111*b*.

When the valve element 104 and the guide 106 are inserted in the toner supply port 111*b*, the claws 113*a* and 114*a* are pressed by the tapered face 109*a* of the lid 109 and are shifted in mutually opposite directions. When the valve element 104 and the guide 106 is further inserted in the toner supply port 111*b* to shift the claws 113*a* and 114*a* radially outwardly of the small-diameter portion 106*a* of the guide 106, the claws 113*a* and 114*a* approach to each other by the elastic force of the spring 115. As a result, the claws 113*a* and 114*a* are axially overlapped and engaged with the lid 109, as shown in FIGS. 10B and 14A. This engagement restrains the extraction of the valve element 104 from the toner supply port 111*b*. As shown in FIG. 10C, by pulling up the toner container 102 relative to the valve element 104 whose extraction from the toner supply port 111*b* is restrained, the valve element 104 is shifted to the above-described opening position.

To supply the toner 117 to the developing apparatus according to the above-described configuration, the sealing element 108 closing the opening 102*a* of the toner container 102 is first removed. Next, the cover 103 is fitted into the connector 102*b* of the toner container 102 to constitute a toner cartridge 100. Next, the cap 116 covering the tip of the guide 106 of the cover 103 is removed. Then, the valve element 104 and the guide 106 are inserted in the toner supply port 111*b* with the tip of the guide 106 downward, as shown in FIG. 10A. The valve element 104 is further inserted to engage the claws 113*a* and 114*a* with the lid 109 of the valve element 104, as shown in FIG. 10B, to restrain the extraction of the valve element 104 from the toner supply port 111*b*. Then, the toner container 102 is pulled up to shift the valve element 104 to the opening position, as shown in FIG. 10C. As a result, the toner 117 in the toner container 102 is discharged from the toner run-off ports 110*b* into the toner supply port 111*b*. After completion of supply of the toner 117, by pressing the knob 112*b* to disengage of the claws 113*a* and 114*a* of the arms 113 and 114 with the valve element 104, the toner cartridge 100 can be removed from the developing apparatus.

According to the above-described apparatus for toner supply, the toner 117 can be supplied to the developing apparatus solely by inserting the valve element 104 in the toner supply port 111*b* and pulling up the toner container 102. Because the extraction of the valve element 104 is restrained as a result of its insertion in the toner supply port 111*b*, leakage of the toner 117 from the toner supply port 111*b* during toner supply is prevented. The valve element 104 can be incorporated in the cover 103 very simply by inserting the chute 110 in the guide 106 from outside, so that the assembling process can be simplified. Moreover, the auxiliary device for toner supply 101 can be reused on different toner containers, and is therefore economical, because it is attachable to, and detachable from, the toner container 102.

Figure 16A:
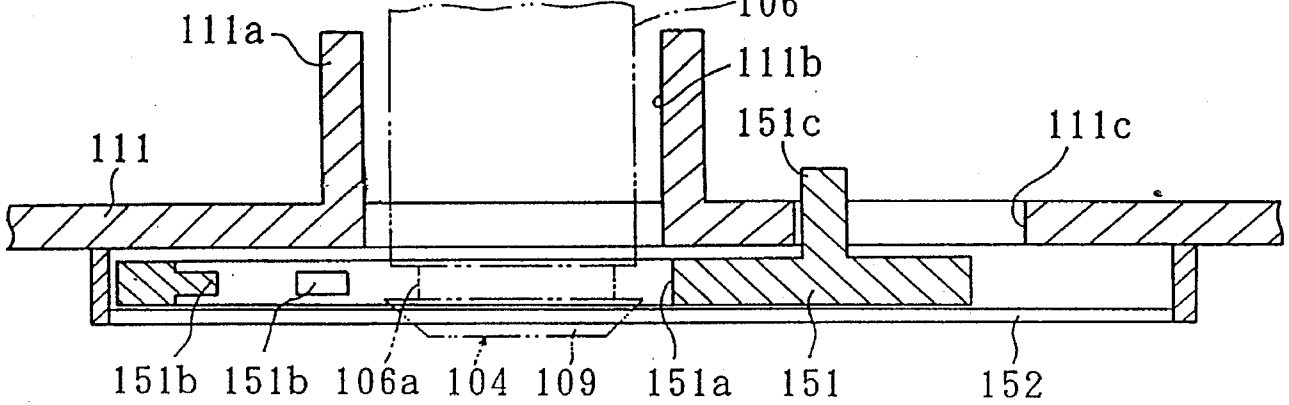
FIG. 16A is a cross-sectional view of the restraint element of a modification of the second embodiment in a derestricted condition.
Figure 16B:
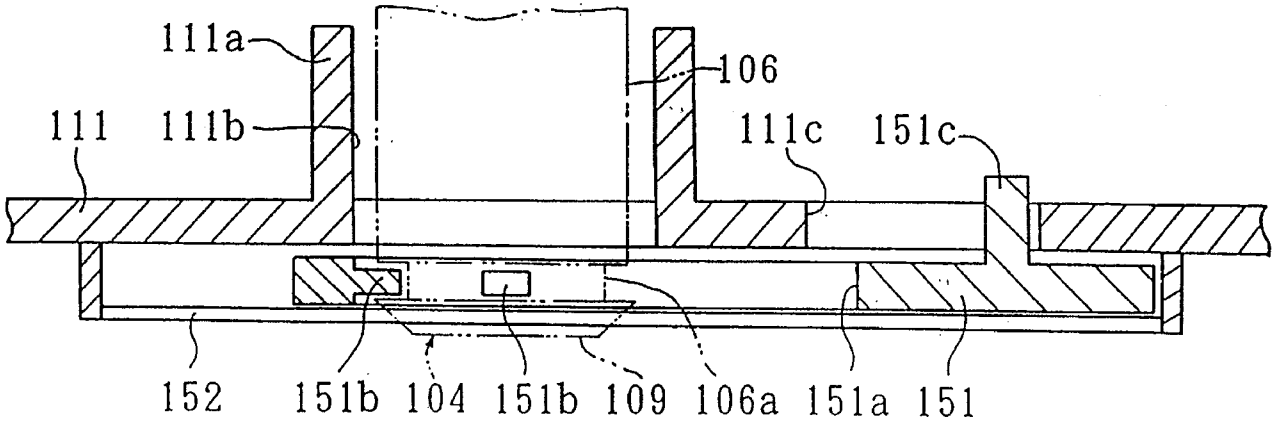
FIG. 16B is a cross-sectional view of the restraint element of a modification of the second embodiment in a restrained condition.
Figure 17:
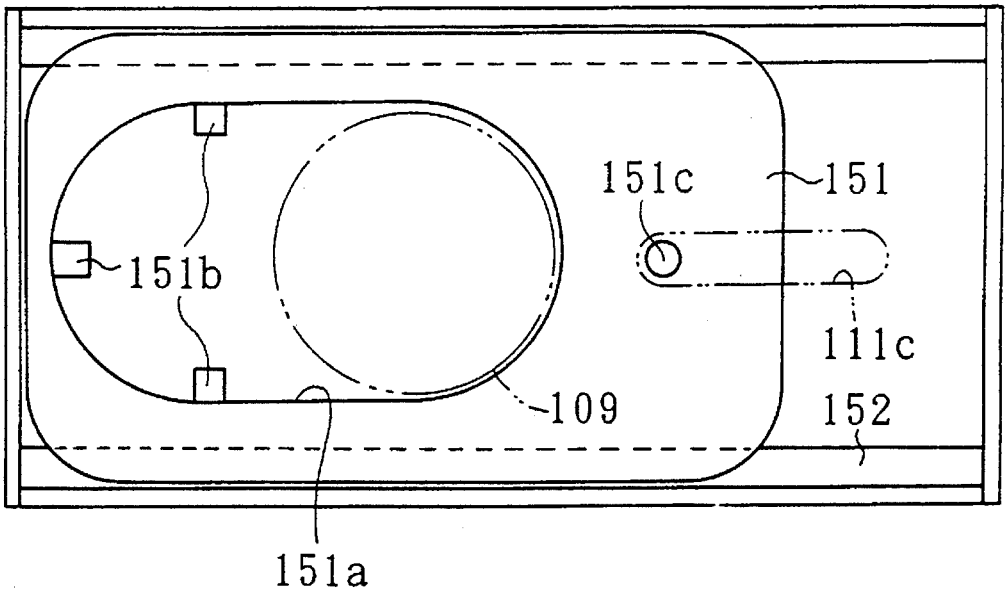
FIG. 17 is a plan view of the restraint element of a modification of the second embodiment.
Figure 18A:
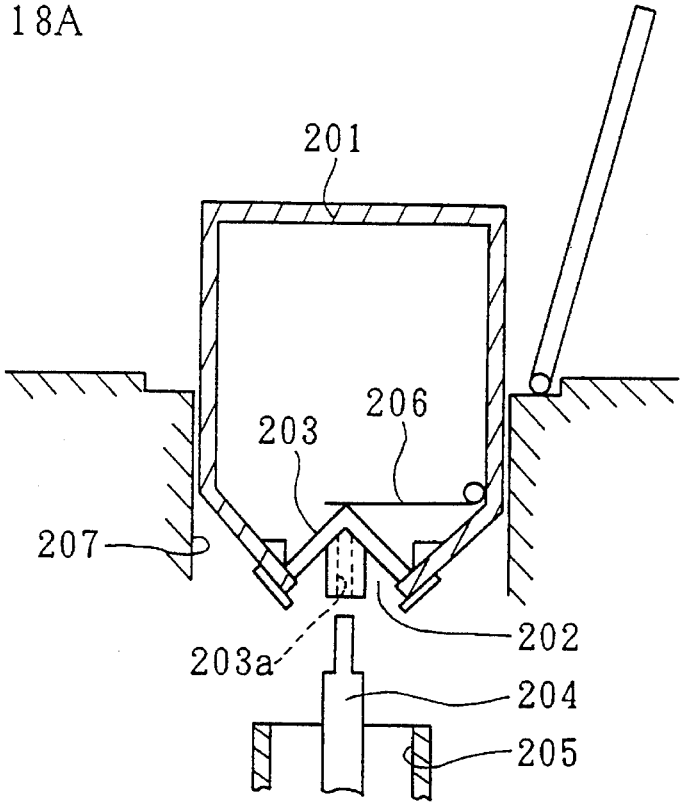
FIG. 18A is a cross-sectional view of a conventional apparatus for toner supply before toner supply.
Figure 18B:
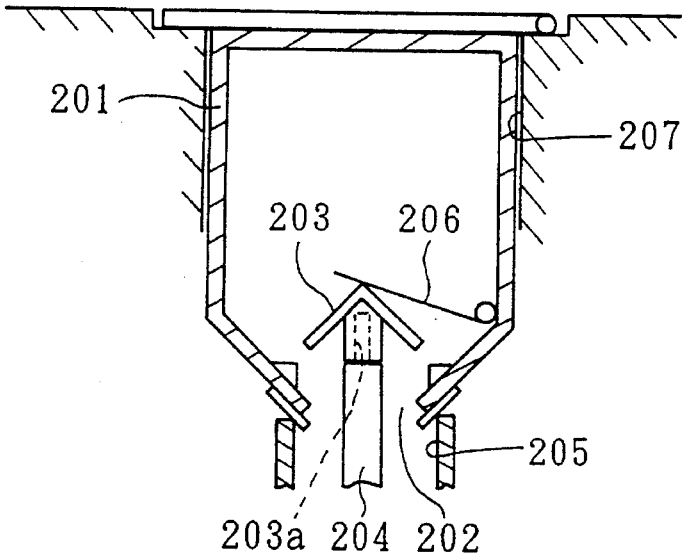
Prior Art Fig. 18B
FIG. 18B is a cross-sectional view of the conventional apparatus for toner supply during toner supply.

FIGS. 16A, 16B and 17 show modifications of the restraint element. The restraint element is configured with a sliding plate 151 arranged under the toner supply port 111*b*. The sliding plate 151 is supported by a frame-shaped guide element 152 fixed inside the toner storage tank 111, so that it is reciprocally movable in the left-right direction in the figure. The sliding plate 151 has an upwardly protruding knob 151*c* whose end protrudes out of the toner storage tank 111 via a long hole 111*c*. The sliding plate 151 has a long hole 151*a* whose longitudinal direction agrees with the direction of movement of the sliding plate 151. At one end side (left side in the figures) of the inner circumference of the long hole 151*a* are provided three claws 151*b*. As shown in FIGS. 16A and 17, into the other side (right side in the figures) of the long hole 151*a* of the sliding plate 151, the lid 109 of the valve element 104 and the small-diameter portion 106*a* of the guide 106 of the toner supply port 111*b* can be inserted. By shifting the sliding plate 151 to the right in the figures while the valve element 104 and small-diameter portion 106*a* are inserted as above, the three claws 151*b* are placed radially outwardly of the small-diameter portion 106*a* and axially overlapped with the lid 109, so that the claws 151*b* are engaged with the lid 109. This engagement restrains the extraction of the valve element 104 from the toner supply port 111*b*. The other aspects of this modification are the same as in the second embodiment.

What is claimed is:

1. An auxiliary device for toner supply to a developing apparatus, comprising:

a cover attachable to, and detachable from, a toner container and capable of covering an opening of the toner container;

the cover having an outlet formed for communication with the inside of the toner container; and a valve element capable of closing the outlet;

wherein the valve element can be shifted to an opening position by being pressed up by a pressing-up portion on the developing apparatus side, so that the toner can be supplied from the toner container to the developing apparatus.

2. The auxiliary device for toner supply according to claim 1, wherein:

the cover has a pipe-shaped guide extending outwardly from the periphery of the outlet thereof;

the valve element has a pipe-shaped chute inserted in the guide;

the chute has a toner introduction port formed therein; and the chute is pressed up by inserting the pressing-up portion, which has a pipe-shape and constitutes a toner supply port on the developing apparatus side, into the guide to shift the toner introduction port to a position for communication between the inside and outside of the toner container, so that the toner introduced in the chute via the toner introduction port from the toner container can be fed to the toner supply port.

3. The auxiliary device for toner supply according to claim 2, wherein:

the valve element has a main body capable of coming in contact with, and breaking contact with, the periphery of the outlet, from the main body the chute extends;

there are means of reversibly bringing the main body into contact with the periphery of the outlet; and the outlet is closed by the valve element upon contact of the main body with the periphery of the outlet.

4. The auxiliary device for toner supply according to claim 2, wherein:

the valve element has a main body capable of coming in contact with, and breaking contact with, the periphery of the outlet, from the main body the chute extends;

the main body and the toner introduction port are arranged at a distance in the axial direction; and the radial gap between the outer circumference of the chute and the inner circumference of the guide is sufficiently narrow to seal the toner over the axial distance between the main body and the toner introduction port.

5. A cartridge for toner supply to a developing apparatus, comprising:

a toner container;

a valve element capable of closing an outlet formed for communication with the inside of the toner container;

a pipe-shaped guide extending outwardly from the periphery of the outlet;

the valve element having a pipe-shaped chute inserted in the guide; and the chute having a toner introduction port formed therein;

wherein the chute is pressed up by inserting a pipe-shaped pressing-up portion, which constitutes a toner supply port on the developing apparatus side, into the guide to shift the toner introduction port to a position for communication between the inside and outside of the toner container, so that the toner introduced in the chute via the toner introduction port from the toner container can be fed to the toner supply port.

6. The cartridge for toner supply according to claim 5, comprising:

an auxiliary device for toner supply having a cover attachable to, and detachable from, the toner container and capable of covering an opening of the toner container, and the valve element;

wherein the outlet and the guide are formed in the cover.

7. The auxiliary device for toner supply according to claim 5, wherein:

the valve element has a main body capable of coming in contact with, and breaking contact with, the periphery of the outlet, from the main body the chute extends;

there are means of reversibly bringing the main body into contact with the periphery of the outlet; and the outlet is closed by the valve element upon contact of the main body with the periphery of the outlet.

8. The auxiliary device for toner supply according to claim 5, wherein:

the valve element has a main body capable of coming in contact with, and breaking contact with, the periphery of the outlet, from the main body the chute extends;

the main body and the toner introduction port are arranged at a given distance in the axial direction; and the radial gap between the outer circumference of the chute and the inner circumference of the guide is sufficiently narrow to seal the toner over the axial distance between the main body and the toner introduction port.

* * * * *